United States Patent [19]

Tesoro

[11] 4,270,417

[45] Jun. 2, 1981

[54] TWO-WAY RATCHET WRENCH

[76] Inventor: Joseph Tesoro, 9 Dade Rd., New City, N.Y. 10956

[21] Appl. No.: 130,834

[22] Filed: Mar. 17, 1980

[51] Int. Cl.[3] ..... B25B 13/46

[52] U.S. Cl. ..... 81/62; 81/58.3

[58] Field of Search ..... 81/58, 58.3, 58.4, 60, 81/61, 62, 63.1; 192/43.1

[56] References Cited

U.S. PATENT DOCUMENTS 982,886 1/1911 Servatius ..... 81/58.3

FOREIGN PATENT DOCUMENTS 442167 11/1948 Italy ..... 192/43.1

645119 10/1950 United Kingdom ..... 81/58.5

*Primary Examiner*—James L. Jones, Jr.

[57] ABSTRACT

In a preferred embodiment of the invention, a hand wrench handle includes on an end thereof a socket-mounting passage-forming structure having mounted therein a revolvable socket of cylindrical shape shiftable axially along a longitudinal axis of the cylindrically-shaped socket between alternate first and second positions, in a first position circumscribing teeth being engaged with a first ratchet key locking against movement in one of clockwise and counter-clockwise directions, and in a second position circumscribing other teeth being engaged with a second ratchet key locking against movement in a remaining other one of clockwise and counter-clockwise directions, with the socket being intermittently secured in one or the other of the alternate positions and shiftable therebetween by a mounted biasing spring mounted on the socket-mounting passage-forming structure pressing a ball into alternate parallel circumscribing grooves on the outer wall of the socket.

8 Claims, 5 Drawing Figures

TWO-WAY RATCHET WRENCH

This invention relates to a novel two-way ratchet socket wrench.

BACKGROUND OF THE INVENTION

Prior to the present invention there have not existed commercially practical two-way ratchet wrenches devoid of switches in the way, or switches that have to be moved with pains-taking difficulty, particularly when the person has greasy hands or fingers as is often the case when doing mechanical work on engines or vehicles, etc. For example, there is the U.S. Pat. No. 934,333 to Wicker which has a switch lever that has to be moved between alternate positions, in one position being engageable of one set of ratchet teeth and in the alternate position being engageable with a second alternate set of ratchet teeth, in order to shift between alternately locking against one or the other of clockwise and counter-clockwise movement of the socket. In that patent the switch member, or handle of the switch, is readily knocket to unintentionally shift, as well as being susceptable to being damaged by striking during use. In the U.S. Pat. No. 2,978,081, the mechanism is slightly different and the manipulator or switch lever is supposedly located on an upper face, such that a person uses the socket wrench only in one position, always face-up. As earlier noted, such manipulator is susceptable to being struck when working in tight area spaces having limited maneuvering space. There also is the question in these types of mechanisms discussed above, as to whether or not the switch will possible accidentally shift when subjected to high stresses.

SUMMARY OF THE INVENTION

Objects of the invention include obviating potential problems and undesirable features characteristic of prior devices, together with the achieving of novel advantages and features not heretofore available.

A particular object is to obtain a two way ratchet wrench devoid of protruding levers.

Another object is to obtain a two way ratchet wrench having a novel mechanism for shifting between alternate ratchet directions of operation.

Another object is to obtain a ratchet wrench having the advantage of use in either face-up or face-down position equally well, having a two way ratchet, alternately usable.

Another object is to obtain a two way ratchet wrench having a mechanism of shifting from one ratchet direction to the opposite ratchet direction, of a mechanism instantly and easily shiftable, but sturdy against accidental shifting from one to the other ratchet positions.

Another object is to obtain preceding one or more objects by a combination of low-cost construction and simple mechanism.

Other objects become apparent from the preceding and following disclosure.

One or more objects are obtained by the invention as illustrated in the accompanying drawings which are intended solely for improving understanding but not intended to unduly limit the invention which obviously includes other embodiment apparent to a person of ordinary skill within the spirit of the invention.

Broadly the invention may be described as a socket wrench having alternate two-way ratchet mechanism, in which the socket cylinder is axially shiftable along the longitudinal axis of the socket between alternate ratchet positions, being shiftable within circumscribing mounting inner walls of a socket-mounting passage-forming structure, typically and preferably having a handle on the socket-mounting passage-forming structure. The shift and alternate-position securing mechanism is preferably that of having parallel circumscribing groove on either the socket outer circumscribing wall intermediate of its top and bottom ends, or on the inner circumscribing wall of the socket-mounting passage-forming structure in the passage thereof, and having on the remaining other opposite opposing wall a spring mounting a ball-like member, preferably a spherical ball pressed into the one or the other groove, one groove position corresponding to one ratchet-engagement position with a ratchet key for one direction, and the other groove position corresponding to the remaining other ratchet-engagement position for the other direction of operation.

Preferably the ratchet teeth are located at upper and lower opposite ends of the socket on a surface of an overhanging lip, a separate overhanging lip at each of opposite ends, such that shifting from one groove to the other brings one set of ratchet teeth into engagement with one spring-biased ratchet key, while moving the opposite-end ratchet set of teeth on the other socket lip out of prior engagment with another ratchet key at the other end of the passage.

Preferably the parallel grooves circumscribe the outer wall of the socket, and the biasing spring is mounted on and against the inner circumscribing wall surface of the socket-mounting passage-forming structure. Likewise, the spring-biased keys at opposite ends of the passage of the socket-mounting passage-forming structure, are mounted on and within space of the inner circumscribing wall surface of the socket-mounting passage-forming structure, preferably.

The invention may be better understood by making reference to the accompanying Figures as described below.

THE FIGURES

FIG. 1 illustrates an elevation plan view of a top face of the two-way ratchet wrench, noting that both top and bottom faces are identical in appearance.

FIG. 2 illustrates the socket cylinder of the two-way ratchet wrench of FIG. 1, shown in side view with the socket-mounting passage-forming structure shown in phantom and the lower ratchet key thereof also in phantom in engaged state, and with the upper ratchet key thereof also in phantom in disengaged state, and illustrating the parallel circumscribing grooves on the outer intermediate wall of the socket cylinder, FIG. 3 illustrates a cross-sectional view as taken along lines 3—3 substantially, of FIG. 4 the mounting and operating mechanisms of the oppositely-directed keys mounted within the inner wall surface of the socket-mounting passage-forming structure.

FIG. 4 illustrates an elevation plan view of a top face of the socket-mounting passage-forming structure, with partial cut-away for further illustrating the mechanism of the alternate positions-securing elements, and further illustrating the pivoting nature of the ratchet keys, as shown for one key mounted pivotally within a socket-hole in the inner wall of the socket-mounting passage-forming structure.

FIG. 5 illustrates in enlarged view the portion 5 of the structure shown in FIG. 4.

DETAILED DESCRIPTION

Figure 1:
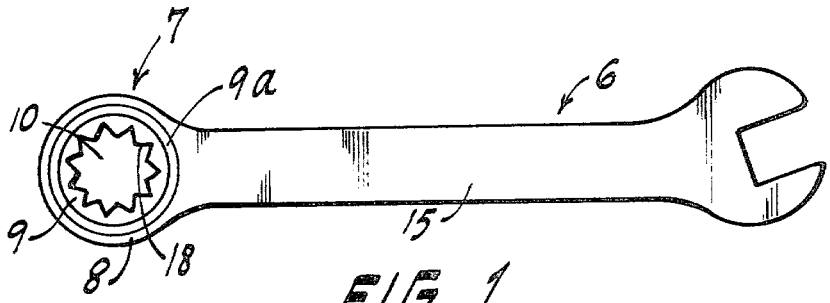

In greater detail, FIGS. 1 through 5 all illustrate a common preferred embodiment, none of which as illustrated are intended to be exactly to scale, merely being for illustrating typical appearance and mechanism of operation and function, diagrammatically.

The two-way ratchet wrench 6 has a revolvable socket end 7 which includes the revolvable socket 9 with an integral overhang lip-ring wedged thereon non-removably (with appropriate permanent attaching mechanism so that it does not come off), the lower face of the top overhang lip having ratchet teeth 9*b* on the body portion 9*a*. The revolvable socket 9 is mounted within passage space 16 of the socket-mounting passage-forming structure 8, which on each of upper and lower faces thereof has a recess 8*a* and 8*b* respectively into which the ratchet teeth 9*b* and 9*b'* respectively are seatable, and when so-seated engageable with its respective ratchet key 10 or 10'. The parallel grooves 11*a* and 11*b* respectively each circumscribe the revolvable socket and are adjacent, within the outer circumscribing intermediate wall 11*c* of the revolvable socket.

The key 10, for example, like the key 10', is biased into latching locking position by a biasing spring 13 which when bent into space 12*a* permits the key to become depressed for the ratchet slip-action when engaged with teeth 9*b*, the spring 13 being fitted retainably into depressed cut-out space 14.

Accordingly, light pressure will cause the socket cylinder herein termed revolvable socket 9 to move axially along a longitudinal axis of the annulus space 10 thereof, from one position of the spring-biased ball 11*d* to the alternate groove other position. The spring-biased ball 11*d* is mounted within recess hole 11*e* within which spring 11*f* biases outwardly the spring-biased ball 11*d*, in the face of the inner circumscribing wall of the socket-mounting passage-forming structure 8, as wall 17.

When in a particular socket position, for applying gripping force by the gripping surface 18, there is inherently normally present a torque when turning the wrench, such that the revolvable socket 9 locks against the wall 17 thereby avoiding accidental shifting from one ratchet-position to another.

Figure 2:
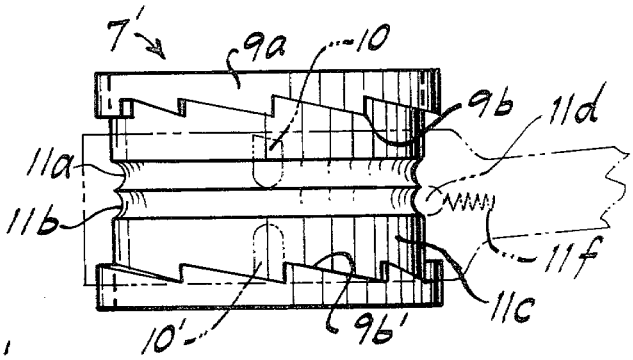
Figure 4:
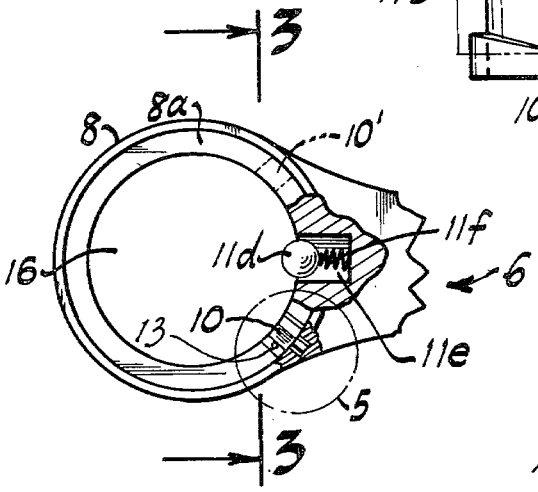
Figure 3:
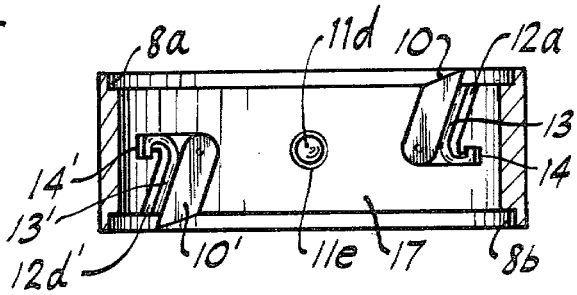
Figure 5:
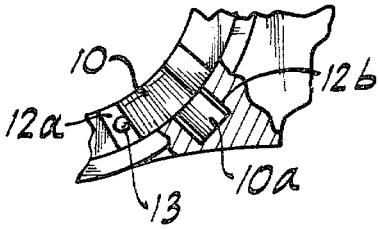

In the one position such as shown in FIG. 2, when the revolvable socket 9 is fixedly gripped on a nut or the like, the handle 15 and socket-mounting passage-forming structure 8 will be revolvable clockwise around the revolvable socket 9, and the nut can be forced to revolve or turn counter-clockwise in direction.

In the alternate position, of the ball 11*d*, the nut could be forcefully revolved or turned in a clockwise direction.

Otherwise, the wrench is like other tools, made normally of an appropriate metal or alloy or the like.

It is within the scope and spirit of the invention to make such variations and modifications and substitution of equivalents as might be obvious to a person of ordinary skill, such as for example merely switching the wall on which the ball is mounted and concurrently placing the parallel grooves on the other opposite different wall.

I claim:

1. A two-way ratchet wrench comprising in combination: a socket element having a substantially cylindrical outer circumscribing surface and shaped in the nature of a cylinder having circumscribing overhanging lips at each of opposite ends of the cylinder overhanging radially outwardly, and each of the overhanging lips having a ratchet toothed surface circumscribing said cylinder with the ratchet toothed surface at one of said overhanging lips being shaped to engage a key when the socket element is attempted to be moved in a first revolving direction and with the ratchet toothed surface at a remaining other one of said overhanging lips being shaped to engage a key when the socket element is attempted to be moved in an opposite second revolving direction opposite to said first revolving direction, and said cylinder having an outer circumscribing intermediate wall located between said circumscribing overhanging lips, and said outer circumscribing wall including an alternate position means for adjusting said cylinder axially along a longitudinal axis of the cylinder; and socket mounting means for mounting said socket element revolvably therein, including a mounting housing having a through passage of substantially circular cross-section at an inner-wall surface of the mounting housing, of a size and shape to revolvably mount and support said socket element at said outer circumscribing intermediate wall at positions between said circumscribing overhanging lips, said inner-wall surface including a portion of said alternate position means such that said socket element can be shifted between alternate first and second positions by to and fro alternate movement of said cylinder axially along said longitudinal axis, and said inner-wall surface further having mounted thereon a key means providing a first key engageable and lockable of the ratchet toothed surface of said one of said overhanging lips when said socket element is positioned in said first position and providing a second key engageable and lockable of the ratchet toothed surface of said remaining other one of said overhanging lips when said socket element is positioned in said second position, such that in said first position said socket element is locked against movement in one of clockwise and counter-clockwise directions and such that in said second position said socket element is locked against movement in a remaining other one of said clockwise and counter-clockwise directions.

2. A two-way ratchet wrench of claim 1, including a gripping circumscribing shaped surface along a circumscribing inner wall of said cylinder.

3. A two-way ratchet wrench of claim 2, in which said alternate position means includes parallel circumscribing grooves on one of said inner-wall surface and said outer circumscribing intermediate wall, and further includes a spring-biased slidable-key means mounted on a remaining one of said inner-wall surface and said outer circumscribing intermediate wall, such that the spring-biased slidable-key member intermittently secures said socket element alternately in said first and second positions when the socket element is moved from one to the other of said first and second positions, by said spring-biased slidable-key member being spring-biased into alternate ones of said parallel circumscribing grooves.

4. A two-way ratchet wrench of claim 3, in which said spring-biased slidable-key means includes a spring mounted against a supporting surface and a ball-element pressed by said spring against concave surfaces of said grooves when alternately in said first and second positions.

5. A two-way ratchet wrench of claim 4, in which said socket mounting means includes a graspable handle adapted for holding and maneuvering the wrench.

6. A two-way ratchet wrench of claim 1, in which said alternate position means includes parallel circumscribing grooves on one of said inner-wall surface and said outer circumscribing intermediate wall, and further includes a spring-biased slidable-key means mounted on a remaining one of said inner-wall surface and said outer circumscribing intermediate wall, such that the spring-biased slidable-key member intermittently secures said socket element alternately in said first and second positions when the socket element is moved from one to the other of said first and second positions, by said spring-biased slidable-key member being spring-biased into alternate ones of said parallel circumscribing grooves.

7. A two-way ratchet wrench of claim 6, in which said spring-biased slidable-key means includes a spring mounted against a supporting surface and a ball-element pressed by said spring against concave surfaces of said grooves when alternately in said first and second positions.

8. A two-way ratchet wrench of claim 1, in which said socket mounting means includes a graspable handle adapted for holding and maneuvering the wrench.

* * * * *